US007178793B2

(12) United States Patent
Jursich

(10) Patent No.: US 7,178,793 B2
(45) Date of Patent: Feb. 20, 2007

(54) REPLACEMENT EVAPORATIVE ELEMENT AND CLIP SYSTEM FOR A HUMIDIFIER

(75) Inventor: Donald N. Jursich, Crystal Lake, IL (US)

(73) Assignee: RPS Products, Inc., Hampshire, IL (US)

( * ) Notice: Subject to any disclaimer, the term of this patent is extended or adjusted under 35 U.S.C. 154(b) by 50 days.

(21) Appl. No.: 11/147,529

(22) Filed: Jun. 8, 2005

(65) Prior Publication Data

US 2006/0279008 A1 Dec. 14, 2006

(51) Int. Cl.
*B01F 3/04* (2006.01)

(52) U.S. Cl. ..... 261/106; 261/107

(58) Field of Classification Search ..... 261/100, 261/101, 103, 104, 106, 107
See application file for complete search history.

(56) References Cited

U.S. PATENT DOCUMENTS

| | | | | |
|---|---|---|---|---|
| 2,175,903 | A | 10/1939 | Lichtman | |
| 3,139,462 | A | 6/1964 | Scott | |
| 3,284,068 | A * | 11/1966 | Goettl | 261/97 |
| 4,251,583 | A * | 2/1981 | Donachiue | 428/137 |
| 5,374,381 | A * | 12/1994 | Schuld et al. | 261/106 |
| 5,478,505 | A * | 12/1995 | McElfresh et al. | 261/30 |
| 5,540,867 | A | 7/1996 | DeBello | |
| 5,800,741 | A | 9/1998 | Glenn et al. | |
| 5,971,370 | A * | 10/1999 | Galabinski | 261/97 |
| 6,168,140 | B1 * | 1/2001 | Akazawa | 261/80 |
| 6,416,043 | B1 * | 7/2002 | Eisenbraun | 261/104 |
| 6,877,724 | B1 * | 4/2005 | Petty et al. | 261/30 |
| 7,073,782 | B2 * | 7/2006 | French et al. | 261/100 |
| 2002/0109245 | A1 | 8/2002 | Schuld | |

* cited by examiner

*Primary Examiner*—Scott Bushey
(74) *Attorney, Agent, or Firm*—Greer, Burns & Crain, Ltd.

(57) ABSTRACT

An evaporative element and clip system for supporting the evaporative element in a humidifier includes a humidifier housing having an evaporative element support and an evaporative element having a water retaining media layer and at least one support layer, where the evaporative element is attached to the support layer. This system also has a clip having at least a first and a second wall, a hook and a connecting bridge. The walls removably grip the evaporative element support by friction and are connected to each other by the connecting bridge. The hook is attached to the first wall, wherein the support layer supports the evaporative element when it is removably attached to the hook.

11 Claims, 2 Drawing Sheets

REPLACEMENT EVAPORATIVE ELEMENT AND CLIP SYSTEM FOR A HUMIDIFIER

BACKGROUND

This invention relates to a evaporative element and clip system for a replacement evaporative element for a humidifier. More specifically, the invention relates to a clip that supports a replacement evaporative element within the humidifier.

Humidifiers are manufactured and sold with replaceable evaporative elements, also known as filter cartridges or wicking elements. The purpose of the evaporative element is to spread water over a large surface area to promote evaporation of the water into the air that freely passes through the element. The evaporative element may also perform a subsidiary function of filtering the air and/or water. It is well recognized in the art that it is desirable to have an element that has a large surface area. It is also well known to make the evaporative element from materials that promote capillary or wicking action to absorb and spread water throughout the evaporative element, maximizing the wetted surface area. Coatings are well known that aid water retention and distribution on non-porous surfaces. The evaporative element should be made of materials and with a configuration sufficient to maintain structural integrity of the evaporative element when it is subjected to prolonged use in water, heat and air flow circulation.

Users sometimes look for third party replacement parts to get different features compared to those made available by the original manufacturer. If a replacement pad sags a short time after installation, a user may try to find a replacement pad made of more durable materials. Flexibility in mounting the replacement pad gives the user a wider range of features from which to choose.

After a period of use, the evaporative element begins to loose its effectiveness and needs to be replaced. Original replacement parts are not always convenient to obtain and can be expensive. As makes and models change, the manufacturer sometimes discontinues marketing a particular replacement evaporative element if it believes there is insufficient market to turn a profit. For these and other reasons, replacement evaporative elements are made available by independent parties and are often adaptable to fit several humidifiers.

The need to retrofit replacement evaporative elements into a wide variety of humidifying units requires finding ways to attach universal evaporative elements that may fit more than a single humidifier. U.S. Pat. No. 3,139,462 describes a supporting clip that hangs from a trough that supplies water to the evaporative element. The lower portion of the clip frictionally fits a tubular frame around the top of the evaporative element to hold it in place. Use of this clip requires that the evaporative element have a frame, and that the frame be positioned to hold the evaporative element at an appropriate height.

U.S. Pat. No. 5,540,867 discloses a hanger for attaching two pads of cross corrugated fill in a liquid-gas contact body. This hanger includes a hook and at least two legs. The legs are approximately perpendicular to each other, with one leg penetrating a transverse slot in the cross corrugated fill, and the other leg stabilizing the hanger at the surface of the fill. Thus, this hanger is useful only when there is a slot somewhere in one of the humidifier pads into which the penetrating leg can be inserted. The hanger can be hung only at the location of the slot. Frequently, there is no such slot present in a humidifier pad.

Neither of the hangers of the prior art provide a system for installation of a replacement evaporative element in a variety of humidifiers. Therefore, there is a need in the art for a hanging system for an evaporative element that is inexpensive and works with a wide variety of evaporative elements.

SUMMARY OF THE INVENTION

The present invention relates to a system for hanging a variety of replacement evaporative elements, such as in a humidifier, which is inexpensive and versatile.

An evaporative element and clip system for supporting the evaporative element in a humidifier includes a humidifier housing having an evaporative element support and an evaporative element having a water retaining media and at least one support layer, where the evaporative element is attached to the support layer. This system also has a clip having at least a first and a second support plate, a hook and a flexible bridge. The first and second support plates each have a gripping surface configured to removably grip the evaporative element support by friction and to be connected to each other by the bridge. The hook is attached to the first support plate, wherein the support layer supports the evaporative element when the support layer is removably attached to said hook.

The system for supporting an evaporative element in a humidifier provides an apparatus for securing a replacement evaporative element that is not shown in the prior art. In the humidifier having an evaporative element support, the original evaporative element included a button or projection secured to the evaporative element. If the original replacement pad is no longer available, an alternative can be obtained using the technology of this invention. A clip is fashioned to fit into the slot on the evaporative element support to hold the evaporative element in place. The plates on the clip are canted toward each other to grip the surface of the support to prevent it from rotating to either side and allowing the evaporative element to fall from the hook.

This system is inexpensive and can be retrofit to almost any humidifier having a support structure for the humidifier element. Once the clip is in place, the evaporative element is hung from it at any convenient location. The weight of the clip and the evaporative element is borne by the bridge on the bottom of the slot.

DETAILED DESCRIPTION OF THE INVENTION

The present invention relates to an evaporative element and clip system, generally 10, for replacement of the worn evaporative pad from certain types of humidifier.

Figure 1:
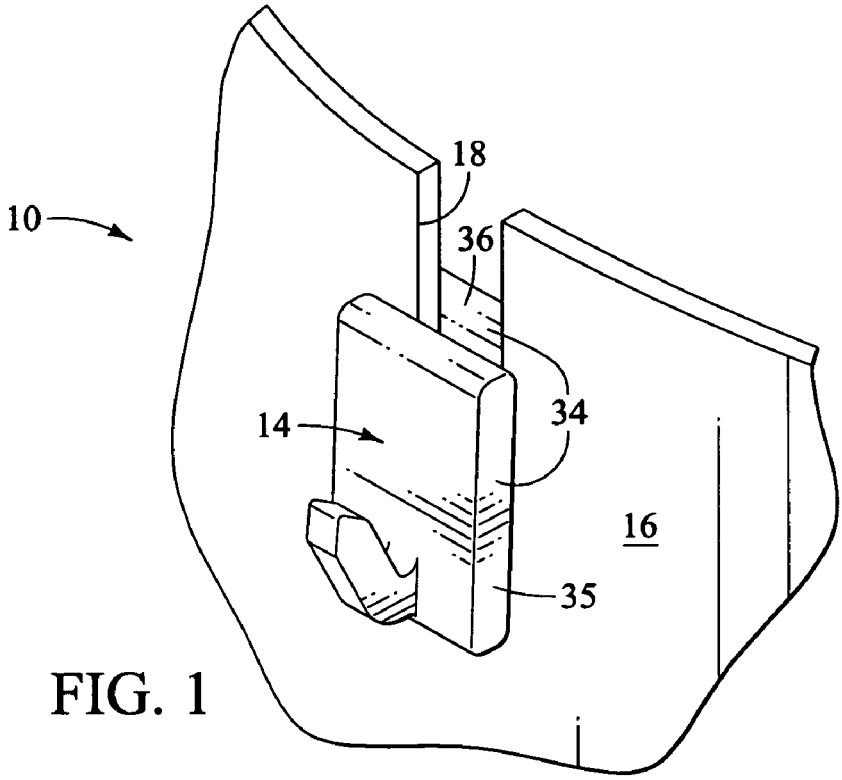
FIG. 1 is a perspective view of the clip installed on a support.
Figure 2:
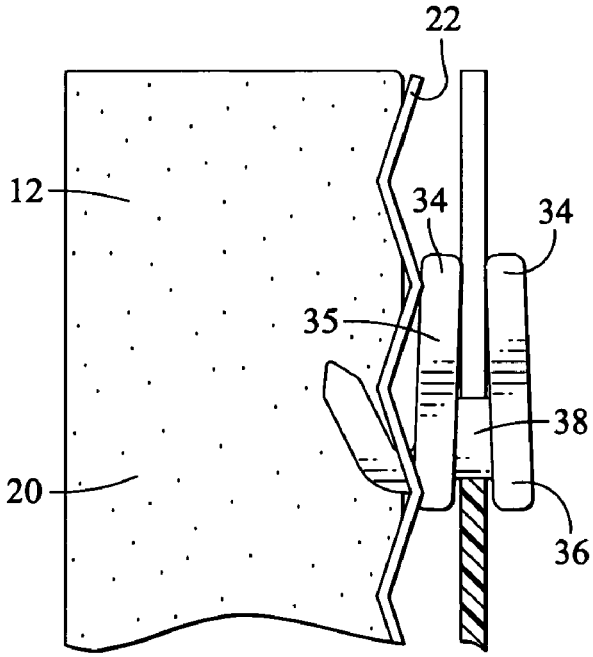
FIG. 2 is a side planar view of the clip of FIG. 1 holding an evaporative element, and with a portion of the support cut away for clarity.

As depicted in FIGS. 1–2, the present system 10 includes an evaporative element 12 and a clip or hanger, generally 14, to hold the evaporative element in place. This system 10 is designed to be installed in a humidifier having a housing with an evaporative element support 16. In some cases, the humidifier (not shown) was designed with an evaporative element support from which the original evaporative element was hung. In other cases, the humidifier has a ledge, trough or other feature that is equivalent to the evaporative element support and is suitable for supporting the clip 14. The exact size and shape of the evaporative element support 16 is unimportant as long as it is sized to allow the clip 16 to hang from it and stay in place by friction. The evaporative element support 16 includes a slot 18 into which the clip 14 is inserted.

Figure 3:
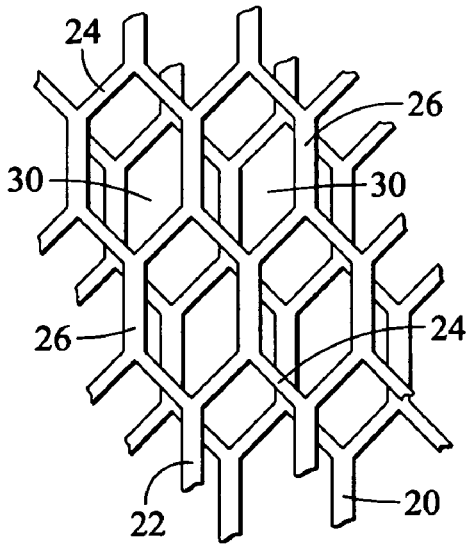
FIG. 3 is a schematic drawing of the structure of the preferred evaporative element.
Figure 4:
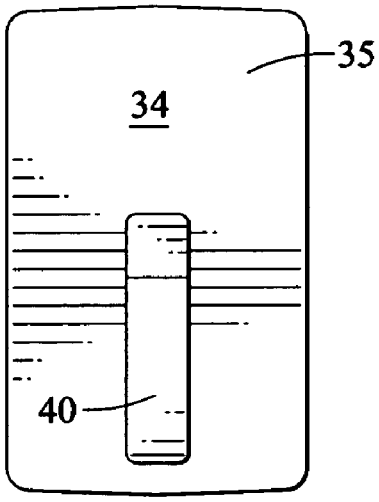
FIG. 4 is a front view of a clip of FIG. 1.
Figure 5:
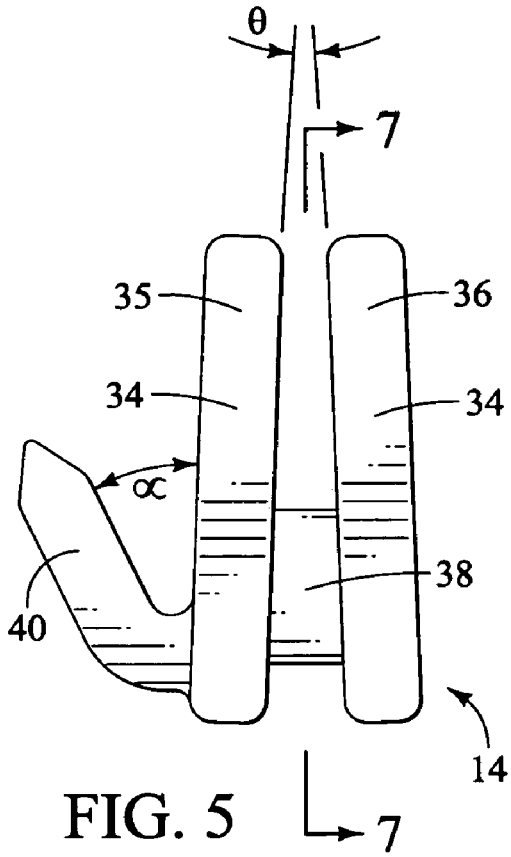
FIG. 5 is a side view of the clip of FIG. 1.
Figure 6:
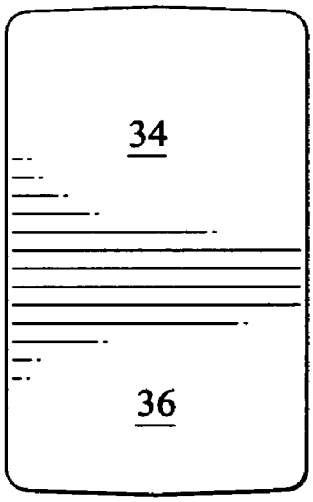
FIG. 6 is a rear view of the clip of FIG. 1.
Figure 7:
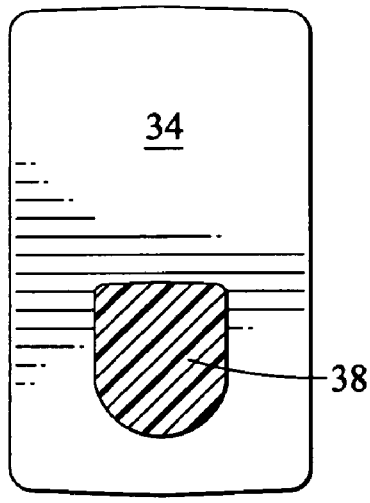
FIG. 7 is a cross section of the clip of FIG. 1 taken through the bridge of the clip, along the line 7—7 of FIG. 5 and viewed from the direction indicated.

The preferred evaporative element 12 includes at least one water retaining media layer 20 and at least one support layer 22. Both the water retaining media 20 and the support layer 22 are preferably made of slit and expanded construction. This construction is known in the art for making evaporative elements for humidifiers, as taught in U.S. Pat. No. 5,374,381, herein incorporated by reference. When the materials are slit and expanded, shown best in FIG. 3, a lattice is formed of bridges 24 and strings 26 defining openings 30 therein. It is desirable to stagger the openings 30 in adjacent layers 32 to expose a greater surface area of the materials to the air flow. Generally, the air flows normally to the layers 32 shown, although in a small scale, the air chooses a tortuous path around the strings 26 and bridge 24 to find openings 30 at each layer. This flow pattern brings the air in contact with more water at the surface of the evaporative element 12. Conventional machinery for slitting and expanding materials are preferably used, resulting in an economical manufacturing process.

The water retaining media 20 may comprise any substance that is air permeable and will hold sufficient water to provide suitable evaporation. Water absorbent materials, such as paper or spongy fabrics are preferred, but non-absorbent materials may be used if sufficient water is held on the surface of the material to provide suitable contact between the air and water.

For example, multiple layers of thin aluminum foil may be used as the water retaining media 20, if the surface is coated to prevent rapid runoff of the water. Such coatings are well known in the art, for example U.S. Pat. No. 2,955,064, herein incorporated by reference, and are generally based on ceramic or clay compositions. Any coating that provides sufficient water retention properties is suitable for use with this invention. Use of coated foil as the water retaining media 20 produces a longer lasting evaporative element 12 because the foil retains its shape longer and is less subject to deterioration than paper media.

Wicking paper is the most preferred water retaining media 20 in this embodiment. The term "wicking paper" is intended herein to mean blotter type papers having superior capillary rise properties. Wicking paper has an exceptional ability to absorb water. It provides a constant supply of water at its surface due to capillary action. As the water evaporates and becomes airborne, the water at the surface of the media 20 is quickly replaced by water being sucked up through the pores of the paper. It also acts to easily distribute water that is distributed to the media 20. If a portion of the paper is immersed in water or in the water path of a trickle down type humidifier, capillary action will also tend to wick away a portion of the water to nearby pores that contain less water. In this embodiment, the resiliency of the paper media 20 tends to expand the media in the unfolded configuration because it tends to decompress itself. This improves the surface area and the ability of the media to hold water compared to the compressed state.

Applicant has discovered that Ahlstrom Filtration grade No. 939-39 paper made by Ahlstrom Filtration, Inc., Mt. Holly Springs, Pa. 17065, is an excellent wicking paper for fabrication of the evaporative element 12 of the invention. The Ahlstrom paper is 97–100% cellulose fiber with a grace of polyamide wet strength resin. The paper has a basis weight of 37–41 lbs. Per ream (20 in.×20 in.×500 sheets). It has a thickness of 0.026 to 0.036 inches. Its wet burst is 150" $H_2O$ min. The Frazier permeability of the Ahlstrom paper is 30–40 cm/ft$^2$. Most importantly, the Ahlstrom grade No. 939-39 paper has a capillary rise ability of 79–112 mm/min. The excellent capillary rise ability of the paper greatly enhances the spreading of water throughout the evaporative element 12, which improves the evaporative rate.

The preferred support layer 22 is a thin metal or plastic layer. This support layer 22 is juxtaposed to at least one of the layers of water retaining media 20 and is suitably rigid to provide structural support to the media layers, and suitably malleable to hold the stacked media layers in a preferred shape. Exact thickness of the support layer 22 must be determined by the shape and size of the evaporative element 12 that is formed and the number of support layers to be used, but generally, relatively thin materials, such as metal foils, are suitable in this application, and are preferred materials. In order to minimize the cost of the evaporative element 12, the thickness of this support layer 22 is preferably no greater than needed to support the evaporative element on the clip 14. Thickness of about 0.008 inches is preferable for the support layer in many applications.

Aluminum foil is the most preferred support layer 22 because of its light weight, malleability and corrosion resistance. The foil 22 must be perforated in some manner to allow flow of air through the layer. Where slit and expanded construction is used for the substantially support layer, it is preferred that the bridges be oriented horizontally. In this position, there is a natural inclination for the bridge to catch and divert cascading water.

Where the water retaining media 20 is sufficiently rigid to provide its own structural support, the support layer 22 and the water retaining material are optionally the same substance. This occurs, for example, where coated aluminum foil is used as the water retaining media 20. When this occurs, both functions may be considered to be performed by a single substance. The support layer 22 is also optionally coated to provide additional water retention.

An adhesive means is used for bonding the layers of media together and for bonding the rigid material layer 22 to the water retaining media 20 layers to form a laminated evaporative element 12. Any adhesive may be used that does not overly hinder the evaporation function by sealing too much of the water retaining surface. Hot melt adhesive has been found to be suitable when used to coat only the edges of the adjoining surfaces. Where slit and expanded construction is used, the edges of the bridges 24 and strings 26 are coated, thereby forming a bond with the bridge or string of the adjacent layer 32.

It is preferable that a single adhesive be used to bond the layers 32 to each other, however, the use of two or more adhesives is contemplated and considered to be within the scope of this invention. The choice of the water retaining media 20 and the support layer 22 may require that one adhesive be required for bonding the water retaining media layers together, and a different adhesive needed to bond the support layer to the water retaining media.

The clip 14 is constructed of at least two walls 34, such as a first wall 35 and a second wall 36, joined to each other by a flexible bridge 38. Any material may be useful in constructing the clip 14, particularly the walls 34. The walls 34 need to have sufficient structural strength to stabilize the position of the clip 14 and the evaporative element 12 hung thereon. Thickness of the walls 34 is not at all important. In some embodiments, the walls 34 are optionally aligned substantially parallel to each other. However, it is not necessary that the walls be parallel, and in fact, it is preferable that they are not parallel in other embodiments. Preferably, the walls 34 are canted toward each other such that when one wall is vertical, the other wall is canted at an angle θ, where θ is from 0° up to about 7° from vertical. More preferably, the angle θ is from about 3° to about 5°.

The walls 34 are connected to each other by the flexible connecting bridge 38, which is suitably made of any material that flexes sufficiently to allow the walls to move to change the angle θ between the walls. Preferably, the length of the connecting bridge 38 is sized to allow the thickness of the evaporative element support 16 to fit between the walls 34 when the clip 14 is installed in the slot 18. Flexing of the connecting bridge 38 has two benefits. It provides a force on the walls that increases the friction between the walls 34 and the evaporative element support 16, holding the clip 14 in place and preventing it from rotating on the connecting bridge 38. Movement of the walls 34 also allows the clip to adjust to minor variations in the thickness of the evaporative element support 16. If the thickness of the evaporative element support 16 is slightly less than the distance separating the walls 34, the walls will separate only as much as is necessary to allow the evaporative element support between them.

In addition to being flexible, the material from which the connecting bridge 38 is made must bear most of the weight of the clip 14 and the evaporative element 12. When inserted into the slot 18, the connecting bridge 38 will usually come to rest on the bottom of the slot. Although the friction of the walls 34 on the evaporative element support 16 take some of the weight, the connecting bridge should be designed for the case where it bears all of the weight of the system. Preferred materials for the connecting bridge 38 include plastics such as polypropylene and polyethylene. Although the connecting bridge 38 could be made of a separate material and attached to the walls 34, preferably the clip 14 is a unitary piece of molded plastic.

The clip 14 also includes a hook 40 that is attached to one of the walls 34, sized and positioned to engage the support layer 22 of the evaporative element 12. The hook 40 extends outwardly from one of the walls 34 at an angle α. Angle α can vary from 0° to 90°, the higher angles being practical if the hook 40 is horizontally displaced a sufficient distance from the wall to allow the evaporative element 12 to engage with the hook. Preferably, the angle α varies from about 30° to about 60°. The size of the hook 40 is not critical as long as it is small enough to fit inside the humidifier and large enough to engage the evaporative element 12.

In a preferred embodiment, the clip 14 is a unitary piece of plastic that has been injection molded. Polyethylene or polypropylene are the preferred materials for injection molding. The component parts are preferably sized so that the clip 14 is easily removed from the mold.

In use, the clip 14 is placed on the evaporative element support 16 with the connecting bridge in the slot 18. The clip 14 is positioned so that the connecting bridge 38 of the clip rests in the bottom of the slot 18 and the hook 40 extends outward in the direction where the evaporative element 12 should be placed. Friction of each of the walls 34 on the evaporative element support 16 keep the clip 14 from rotating to either side. When the clip 14 is in place, the evaporative element 12 is positioned within the humidifier and hung from the hook 40 by the support layer 22.

While specific embodiments of the evaporative element and clip system of the present invention have been shown and described for a humidifier, it will be appreciated by those skilled in the art that changes and modifications may be made thereto without departing from the invention in its broader aspects and as set forth in the following claims.

What is claimed is:

1. A evaporative element and clip system for supporting the evaporative element in a humidifier, said system comprising:

a humidifier housing having a evaporative element support;

a evaporative element having at least one water retaining layer and at least one support layer, said at least one water retaining layer being attached to said support layer; and a clip having at least a first and a second wall, a hook and a connecting bridge, said first and second walls being connected to each other by said connecting bridge, and said hook being attached to said first wall, wherein said support layer supports said evaporative element when said support layer is removably attached to said hook.

2. The system of claim 1 wherein said first wall is canted up to about 70° from being parallel to said second wall.

3. The system of claim 1 wherein said support layer comprises aluminum.

4. The system of claim 1 wherein said evaporative element comprises absorbent paper of slit and expanded construction.

5. The system of claim 1 wherein said support layer comprises slit and expanded construction.

6. The system of claim 1 wherein said clip comprises plastic.

7. The system of claim 1 wherein said connecting bridge is flexible.

8. The system of claim 7 wherein when said first wall is vertical, said second wall is canted at an angle θ from vertical, where θ is up to about 7°.

9. The system of claim 8 wherein θ varies from about 3° to about 5°.

10. The system of claim 1 wherein said hook protrudes at an angle α relative to the first wall, where α varies from 0° to 90°.

11. The system of claim 10 wherein a varies from 30° to about 60°.

* * * * *